US010589347B2

(12) United States Patent
Larsen et al.

(10) Patent No.: US 10,589,347 B2
(45) Date of Patent: Mar. 17, 2020

(54) SAND MOULDING MACHINE AND METHOD OF PRODUCING MOULDS

(71) Applicant: DISA Industries A/S, Taastrup (DK)

(72) Inventors: Per Larsen, Søborg (DK); Christoffer Bay, Præstø (DK); Frederik Juhl Dynesen, Haslev (DK); Henrik Wegge, Ringsted (DK); Torben Hansen, Copenhagen S (DK); Jonas Højslet, Valby (DK); Søren Erik Knudsen, Værløse (DK)

(73) Assignee: DISA INDUSTRIES A/S, Taastrup (DK)

( * ) Notice: Subject to any disclaimer, the term of this patent is extended or adjusted under 35 U.S.C. 154(b) by 268 days.

(21) Appl. No.: 15/735,345

(22) PCT Filed: Jun. 12, 2015

(86) PCT No.: PCT/IB2015/054465

§ 371 (c)(1),
(2) Date: Dec. 11, 2017

(87) PCT Pub. No.: WO2016/198918

PCT Pub. Date: Dec. 15, 2016

(65) Prior Publication Data

US 2018/0214936 A1 Aug. 2, 2018

(51) Int. Cl.
*B22C 11/10* (2006.01)
*B22C 15/28* (2006.01)

(52) U.S. Cl.
CPC ..... *B22C 11/10* (2013.01); *B22C 15/28* (2013.01)

(58) Field of Classification Search
CPC ..... B22C 11/10; B22C 15/28
See application file for complete search history.

(56) References Cited

U.S. PATENT DOCUMENTS 4,313,486 A * 2/1982 Kondo ..... B22C 15/28 164/195
4,791,974 A 12/1988 Larsen
(Continued)

FOREIGN PATENT DOCUMENTS

EP 0 493 977 A2 7/1992
EP 0 493 977 A3 7/1992
(Continued)

*Primary Examiner* — Kevin E Yoon
(74) *Attorney, Agent, or Firm* — Birch, Stewart, Kolasch & Birch, LLP

(57) ABSTRACT

The sand moulding machine (1) includes a moulding chamber (2) formed by a chamber top wall (3), a chamber bottom wall (4), two opposed chamber side walls and two opposed chamber end walls (7, 8). A chamber wall is provided with a sand filling opening (9) communicating with a sand feed system (10). At least one of the chamber end walls is provided with a pattern plate (12, 13) having a pattern (14, 15). At least one of the chamber end walls is displaceable in order to compact sand fed into the moulding chamber. A number of compressed air inlet openings (18, 43) are located in a lower part of the moulding chamber and are arranged to form an upward airflow in at least a part of the moulding chamber in order to create an at least substantially fluidised bed of sand during a sand filling operation.

20 Claims, 2 Drawing Sheets

(56) References Cited

U.S. PATENT DOCUMENTS

Figure 1:
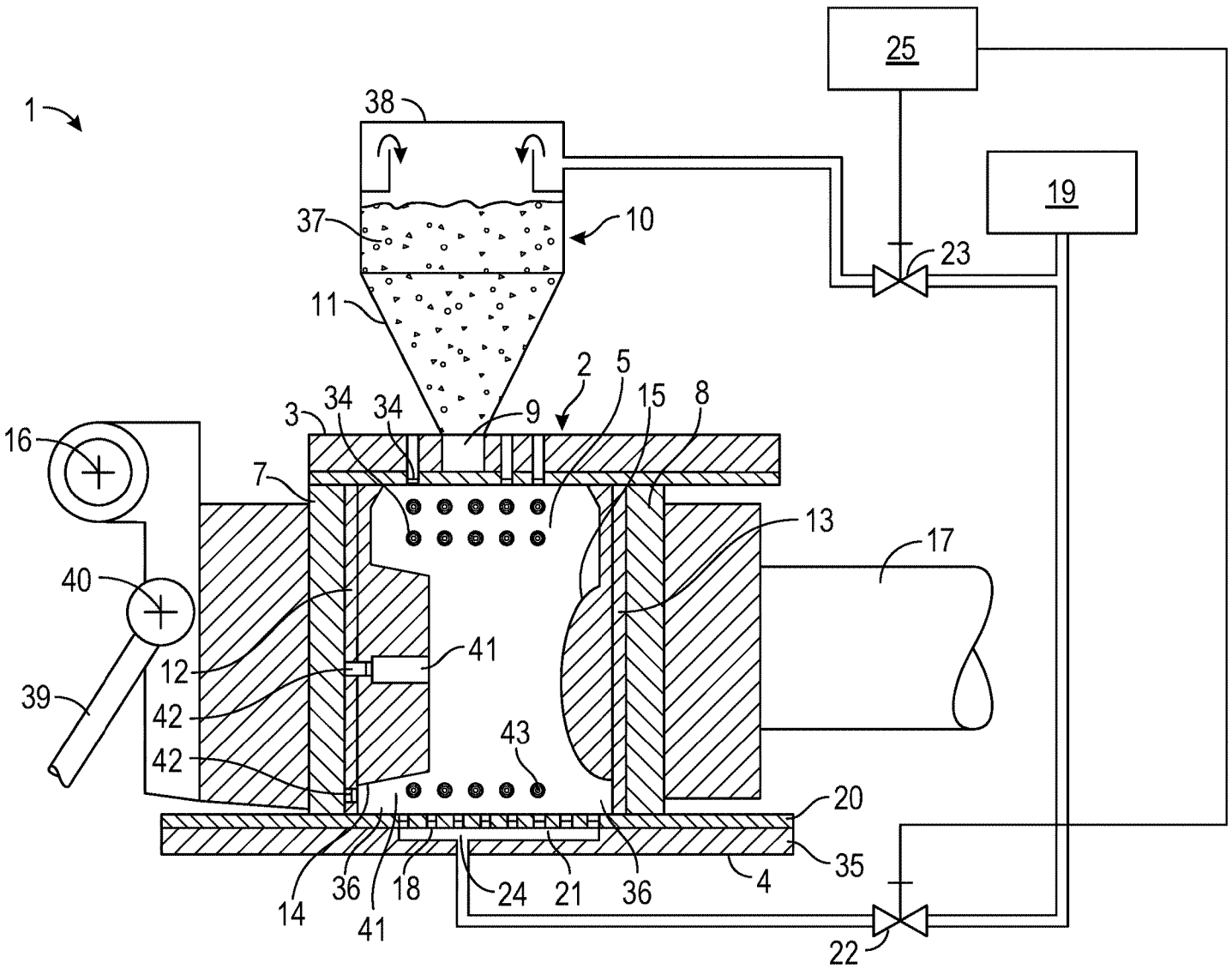

| | | | | |
|---|---|---|---|---|
| 5,161,603 | A * | 11/1992 | Volkomich | B22C 11/10 164/160.1 |
| 2011/0290981 | A1 * | 12/2011 | Hansen | B22C 11/10 249/112 |

FOREIGN PATENT DOCUMENTS

| | | | |
|---|---|---|---|
| JP | 57-142745 | A | 9/1982 |
| JP | 4-200956 | A | 7/1992 |

* cited by examiner

SAND MOULDING MACHINE AND METHOD OF PRODUCING MOULDS

The present invention relates to a sand moulding machine including a moulding chamber formed by a chamber top wall, a chamber bottom wall, two opposed chamber side walls and two opposed chamber end walls, wherein at least one chamber wall is provided with at least one sand filling opening communicating with a sand feed system, wherein at least one of the chamber end walls is provided with a pattern plate having a pattern, wherein at least one of the chamber end walls is displaceable in order to compact sand fed into the moulding chamber, and wherein at least one of the chamber walls is provided with compressed air inlet openings connected to a compressed air source for the delivery of compressed air into the moulding chamber.

Machines of the above mentioned typo are well-known within the field of sand mould production. The produced sand moulds are used for the industrial casting of metal products, the geometry of which can be highly complex.

On automated sand moulding machines, two different types of machines or techniques are often used; the match plate technique such as employed by DISA MATCH (Registered Trademark) horizontal flaskless match plate machines and the vertical flaskless sand moulding technique such as the DISAMATIC (Registered Trademark) technique.

According to the match plate technique, a match plate having moulding patterns on both sides facing away from each other is being damped between two moulding chambers. During the simultaneous moulding of a first and a second sand mould half part the patterns of the match plate are extending into each respective moulding chamber. A slit-formed sand inlet opening extending across a wall is arranged at each moulding chamber.

Simultaneously sand is blown in through each silt-formed opening and into each moulding chamber. Thereafter, the sand is being squeezed by the movement of oppositely arranged press plates being displaced simultaneously in direction towards the match plate. After the squeezing, the moulding chambers are moved away from each other, the match plate is being removed and eventually cores are placed in the moulds. The moulds are then closed and pushed out of the chamber and are ready for pouring liquid metal therein in order to produce metal castings.

According to the vertical flaskless sand moulding technique such as ins DISAMATIC (Registered Trademark) technique, a first and a second plate, each provided with a pattern plate, are arranged oppositely at either end of a moulding chamber. During the moulding of a single mould part the patterns of the pattern plates are extending into each respective end of the moulding chamber. A slit-formed sand inlet opening extending across a wall is arranged typically at the top of the moulding chamber.

Sand is blown in through the slit-formed opening and into the moulding chamber. Thereafter, by displacement of the first and/or the second plate, the plates move relatively in direction towards each other and squeeze the sand therebetween. After being removed from the moulding chamber, the sand mould part is placed adjacent the previously moulded sand mould part on a conveyer. Thereby, two neighbouring sand mould parts form a complete sand mould. The cavity formed by these two sand mould parts constitutes a cavity for the subsequent casting of the metal product.

In general, in order to obtain a satisfactory hardness of the compacted sand during the mechanical compaction by squeezing, a satisfactory density of the sand should have been achieved during filling of the moulding chamber with sand. However, in critical regions or the sand mould, such as regions in the sand mould formed by deep pockets of the pattern or formed under large extensions of the pattern, it is particularly difficult to obtain satisfactory density of the sand during filling of the moulding chamber with sand. Therefore, in the prior art, different attempts have been made in order to improve the sand filling process in order to obtain a generally improved density during sand filling and especially an improved sand filling of critical regions.

U.S. Pat. No. 4,791,974 (Dansk Industri Syndikat A/S) discloses a sand moulding machine utilizing the vertical flaskless sand moulding technique, wherein a moulding chamber is supplied with mould sand from a supply chamber under air pressure applied through suitable air channels, and in which the pressure in the supply chamber is increased gradually from a low to a high value to avoid turbulences in the initial filling stage and ensuing weak spots in the produced mould, while at the same time achieving a short total filling time and a high degree of compaction during the final stage. A vacuum is applied through air-permeable moulding chamber walls, preferably before increasing the pressure in the supply chamber, thus avoiding the formation of air pockets in depressions in the moulding chamber walls or pattern plates that could otherwise cause reduced compactness and density in protruding parts of the shaped body being formed in the moulding chamber.

WO 01/56723 A1 (Georg Fischer DISA A/S) discloses a vertical sand moulding machine similar to the above-described, wherein the vacuum is applied separately to different parts of the pattern plates at different periods of time during the filling step. The vacuum application can be applied during shorter periods only when needed, thereby reducing the drying out of the mould material and reducing the amounts of all to be removed by the vacuum system.

U.S. Pat. No. 5,161,603 (Volkornich et al.) discloses a vertical sand moulding machine wherein a moulding chamber similar to the immediately above described accommodates pattern plates and is supplied by a stream of air with sand mixture delivered through a sand inlet opening in the top of the moulding chamber in a vertical direction and parallel to the pattern plates. The pattern plates are provided with vent openings connected to a vacuum source in order to extract air during sand filling of the moulding chamber. The same vent openings are subsequent to the final compaction of the sand by mechanical pressing connected to a source of compressed air in order to ensure easy extraction of the pattern plates from the produced sand moulds without breakage of delicate parts of the sand moulds. After a tune delay relative to the start of the sand delivery operation, a sand mixture is preliminarily compacted by delivering a stream of compressed air directly into the moulding chamber in a horizontal direction and parallel to the pattern plates. This stream of compressed air is delivered into the moulding chamber through openings in the side walls of the moulding chamber. As a result of the delayed delivery of compressed air, the delivery of the sand mixture is retarded and even interrupted. The stream of compressed air diverts the sand mixture in the moulding chamber towards the pattern plates, thus providing a better filling of narrow deep hollows on pattern surfaces and preliminary compaction of the sand mixture. The sand delivery operation is completed after the end of the preliminary compaction. The sand mixture is finally compacted by mechanical pressing. However, the delayed stream of compressed air delivered into the moulding chamber through openings in the side walls of the moulding chamber may not be sufficient in order to ensure satisfactory distribution of the sand especially in deeper depressions of the pattern or below the pattern next to the bottom wall of the moulding cavity.

U.S. Pat. No. 4,313,486 (Kondo et al.) discloses a sand mould-producing apparatus of the match plate type having a sand blower for vertically supplying sand with the help of a first flow of a pressurized air into a moulding cavity in which a match plate carrying thereon a pattern is positioned. A squeeze plate for squeezing sand in the moulding cavity is positioned opposite thy pattern of the match plate and is provided with air injecting openings for horizontally injecting a second flow of pressurized air directly towards the pattern of the match plate, so that the second flow of pressurized air carries the sand towards the pocketed pattern portion of the pattern and corners adjacent to the pattern during the supply of the seed into the moulding cavity. However, this type of injection of a second flow of pressurized air cannot be applied to a vertical sand moulding machine operating according to the DISAMATIC technique, because two oppositely arranged patterns are extending into the same moulding chamber. Furthermore, this injection of a second flow of pressurized air, although the pressurized air is directed directly towards the pattern of the match plate, may not be sufficient in order to ensure satisfactory distribution of the sand especially in deeper depressions of the pattern or below the pattern next to the bottom wall of the moulding cavity. Furthermore, the injection of a second flow of pressurized air in this direction may even cause a sand-blasting effect leading to an increased wear of the moulding chamber walls and the pattern of the match plate.

SU 1060299 discloses a sand mould-producing apparatus having a moulding chamber provided wish a single pattern plate at its bottom wall. Sand is delivered to the moulding chamber through an opening in a side wall. The top wall has the form of a squeeze plate for squeezing sand in the moulding chamber in order to compact the sand. Similarly to the immediately above described apparatus, the squeeze plate is provided with air injecting openings for injecting a second flow of pressurized air directly towards the pattern plate.

JP H04 200956 A discloses a sand moulding machine including two moulding chambers, each including a displaceable chamber end wall and a bottom wall, wherein a group of air holes is arranged in the chamber end walls and a group of air holes is arranged in the bottom walls, and wherein each group of holes is connected to a valve.

The object of the present invention is to provide a sand moulding machine and a method of producing moulds whereby an increased mould hardness may be achieved in critical regions of the produced sand moulds.

In view of this object, a number of the compressed air inlet openings are located in a lower part of the moulding chamber, said number of the compressed air inlet openings are arranged to form an upward airflow in at least a part of the moulding chamber in order to create an at least substantially fluidised bed of sand at least adjacent a part of the chamber bottom wall during as least a part of a filling operation, whereby the moulding chamber is being filled with sand through the at least one sand filing opening, a number of or all of the compressed air inlet openings are arranged in a number of different groups, the compressed air inlet openings belonging to a specific group are connected to the compressed air source via a specific fluidisation control valve pertaining to said group and adapted to regulate the supply of compressed air to the compressed air inlet openings belonging to said group, the compressed air inlet openings belonging to a specific group are arranged in a corresponding specific area of the chamber bottom wall and/or of the chamber side walls, and a number of said specific areas including compressed air inlet openings belonging to respective specific groups are arranged following each other in the direction from a first chamber end wall to a second chamber end wall.

In this way, by fluidising the sand over the chamber bottom wall during the sand filling operation, the sand may flow like water into otherwise critical regions such as lower and/or deeper areas or pockets of the pattern of the pattern plate. The reason for this is that when the sand is fluidised, a static pressure in the fluidised sand comparable to the hydrostatic pressure in water may urge sand to flow into openings such as pockets of the pattern. Consequently, a more even hardness and strength throughout the produced sand moulds may be achieved by lifting the lower hardness values seen in the critical regions. Therefore, a higher precision of the final metal product subsequently pasted in the sand mould may be achieved due to minimised deformation of the sand mould daring filling with liquid metal and solidification of the metal. Furthermore, a higher quality of the surface of the casted product may be achieved due to reduced penetration of liquid metal into the sand mould during the casting process. A higher quality of the surface of the casted product may reduce or eliminate time-consuming manual finishing work and thereby reduce the costs of the end products. Furthermore, as a result of art obtained more even hardness and strength throughout the produced sand moulds, it may be possible to employ pattern plates having patterns with even deeper pockets, thereby enabling the production of sand moulds having longer protrusions of still suitable hardness and strength. Thereby, a generally more versatile sand moulding machine may be achieved.

In addition, by fluidising the sand at the chamber bottom wall during the filling operation, the sand may more easily flow into peripheral regions of the moulding chamber positioned at the chamber end walls, below the pattern of the pattern plate and next to the chamber bottom wall. Thereby, a greater hardness of the compacted sand of the produced sand mould may be obtained in such critical regions. Consequently, the pattern in the moulding chamber may be arranged closer to such peripheral regions thereof. The corresponding regions of the produced sand moulds may even be utilised for smaller cavities for the subsequent casting of details of the final casting. In fact, the region of the moulding chamber available for the pattern of the pattern plate may therefore become larger in its extension towards the chamber bottom wall and side walls. Therefore, a greater metal casting capacity may be achieved for existing plants.

In an embodiment, a number of the compressed air inlet openings are adapted to direct air in an upward direction. By adapting the compressed air inlet openings to direct air in an upward direction, it may be achieved that a suitable upward airflow is obtained in at least a part of the moulding chamber in order to create an at least substantially fluidised bed of sand at least adjacent a part of the chamber bottom wall. Furthermore, a suitable upward airflow may be achieved at least next to the compressed air inlet openings at least substantially independently of the specific positioning of air vent openings in the moulding chamber.

In an embodiment a number of the compressed air inlet openings are distributed over at least a central area of the chamber bottom wall. Thereby, sand entering the moulding chamber that would normally start piling up at a central area of the chamber bottom wall, may instead be fluidised and thereby better distribute over the entire area of the chamber bottom wall and further into deeper depressions or pockets in the at least one pattern plate. Furthermore, a suitable upward airflow may be achieved at least next to the compressed air inlet openings at least substantially independently of the specific arrangement of air vent openings in the moulding chamber.

In an embodiment, a number of the compressed air inlet openings are distributed over at least a peripheral area of the chamber bottom wall.

In an embodiment, a number of the compressed air inlet openings are distributed over at least an area of the chamber bottom wall which is not covered by a projection of the pattern of a pattern plate onto the chamber bottom wall. Thereby, sand entering a sand filling opening in the chamber top wall and being poured directly vertically down through the moulding chamber may effectively be fluidised instead of starting piling up at a central area at the chamber bottom wall.

In an alternative embodiment, a number of the comprised air inlet openings are distributed over at least an area of the chamber bottom wall which is covered by a projection of the pattern of a pattern plate onto the chamber bottom wall. In certain configurations of the pattern, for instance a pattern having predominantly deep depressions or deep pockets, this embodiment may be preferred.

In an embodiment at least one of the chamber end walls is associated with an air cushion transport system including a number of slide shoes supplied with compressed air and adapted to slide on the chamber bottom wall during displacement of said at least one chamber end wall, and a number of the compressed air inlet openings are distributed over art area of the chamber bottom wall which is not contacted by the slide shoes during displacement of said at least one chamber end wall. This arrangement may be advantageous, because the provision of compressed air inlet openings in the area of the chamber bottom wall where such slide shoes slide on the chamber bottom wall would generally drastically reduce the function of the slide shoes.

In an embodiment, a number of the compressed air inlet openings are distributed evenly or at least substantially evenly over at least a central area of the chamber bottom wall.

In an embodiment, a number of Use compressed air inlet, openings are arranged along a lower edge of at least one of the chamber side walls. Thereby, the fluidisation of sand entering vertically down through the moulding chamber may be even more effective.

In an embodiment, a number of the compressed air inlet openings are arranged along a lower edge of at least one of the chamber end walls. Thereby, fluidisation may be obtained next to the pattern plate. This may be advantageous, for instance in the case of a pattern with deep pockets, i.e. a so-called negative pattern. Furthermore, said number of the compressed air inlet openings may thereby be arranged in the pattern plate and the specific arrangement may therefore be adapted to the specific pattern of the pattern plate so that the arrangement of the compressed air inlet openings is also changed when the pattern plate is changed.

In an embodiment, a number of the compressed air inlet openings are arranged along a lower edge of both the chamber side walls. Thereby, oppositely directed flows of compressed air may meet between the opposed chamber side walls, and a resulting suitable upward airflow may be obtained in at least a part of the mounding chamber, thereby creating an at least substantially fluidised bed of sand at least adjacent a part of the chamber bottom wall.

In an embodiment, a number of the compressed air inlet openings are arranged along a lower edge of one of the chamber side walls, and a number of air vent nozzles are arranged at an upper part of the older opposed chamber side wall, Thereby, as a result of air flowing from said compressed air inlet openings to said air vent nozzles, a suitable upward airflow may be obtained in at least a part of the moulding chamber, thereby creating an at least substantially fluidised bed of sand at least adjacent a part of the chamber bottom wall.

In an embodiment, at least one of the chamber side walls and/or the chamber top wall is or are provided with a number of air veal nozzles arranged in a number of deferent groups, and the air vent nozzles belonging to a specific group communicate with a specific air vent control valve pertaining to said group and adapted to regulate a flow of vent air from the air vent nozzles belonging to said group. Thereby, the vent air flow from the moulding chamber may be suitably controlled according to specific needs, for instance in dependence of the specific structure of the pattern or patterns.

In an embodiment, the air vent nozzles belonging to a specific group are arranged in a corresponding specific area of the chamber side wall and/or of the chamber top wall.

In an embodiment, the air vent nozzles belonging to a specific group are arranged in a corresponding specific area of the chamber side wall, and a number of said specific areas including air vent nozzles belonging to respective specific groups are arranged following each other in a vertical direction. Thereby, for instance, only air vent nozzles arranged relatively high may be open during the sand filling operation, in order to achieve a suitable upward airflow in at least a part of the moulding chamber in order to create an at least substantially fluidised bed of sand, whereas also lower located air vent nozzles may be open curing the subsequent mechanical compaction operation in order to ensure adequate venting during mechanical compaction. Furthermore, for instance, by opening only air vent nozzles arranged relatively high during the sand filling operation, a fluidised bed of sand may be created over a greater past of the height of the moulding chamber when this is desired, for instance when employing a pattern having predominantly deep depressions over the entire height. On the other band, for instance, by opening air vent nozzles arranged over substantially the entire height of the moulding chamber, during the sand filling operation, a fluidised bed of sand may be created predominantly in a lower part of the moulding chamber when this is desired, for instance when employing a pattern having deep depressions only at its lower part.

Suitably, a number of or all of the compressed air inlet openings may be arranged in an area extending not more than 20 percent preferably net more than 15 percent and most preferred not more than 10 percent of the height of the chamber side walls from a lower edge of the chamber side walls. Said area may be located in said lower part of the moulding chamber.

In an embodiment, a number of or all of the compressed air inlet openings located in said lower part of the moulding chamber are connected to the compressed air source via a fluidisation control valve adapted to regulate the supply of compressed air to the compressed air inlet openings. Thereby, the fluidisation of sand entering the moulding chamber may be optimised in that the flow rate may be adjusted appropriately during fluidisation and/or a start and an end time for the fluidisation may be adjusted in order to optimise the sand filling of the moulding chamber.

According to the invention, a number of or all of the compressed air inlet openings are arranged in a number of different groups, and the compressed air inlet openings belonging to a specific group are connected to the compressed air source via a specific fluidisation control valve pertaining to said group and adapted to regulate the supply of compressed air to the compressed air inlet openings belonging to said group. Thereby, the total inflow of compressed air for fluidisation of sand may be adjusted or a larger or smaller area over the chamber bottom wall and/or over a lower part of the chamber side walls and/or over a lower part of the chamber end walls may be fluidised in order to optimise the sand fining of the moulding chamber.

According to the invention, the compressed air inlet openings belonging to a specific group are arranged in a corresponding specific area of the chamber bottom wall and/or of the chamber side walls. Thereby, a certain larger or smaller part of the area over the chamber bottom wall may be fluidised in order to optimise the sand filling of the moulding chamber.

According to the invention, a number of said specific areas including compressed air inlet openings belonging to respective specific groups are arranged following each other in the direction from a first chamber end wall to a second chamber end wall. Thereby, a larger or smaller part of the area over the chamber bottom wall may be fluidised depending on the distance between the first and second chamber end walls during the sand filling operation.

in an embodiment, the sand moulding machine includes a control unit adapted to, during at least the filling operation whereby the moulding chamber is being filled with sand through the at least one sand filling opening, open a number of specific fluidisation control valves pertaining to respective groups of compressed air inlet openings so that compressed air is supplied into the moulding chamber through a number of the compressed air inlet openings distributed over a specific area of the chamber bottom wall.

In an embodiment, said specific area of the chamber bottom wall is an area located between the chamber end walls during the sand filling operation. Thereby, a larger or smaller part of the area over the chamber bottom wall may be fluidised depending on the distance between the first and second chamber end walls and position thereof during the sand filling operation. This may prevent air spill behind the chamber end walls.

In an embodiment, said specific area of the chamber bottom wall is an area depending on the specific design of the pattern of the at least one pattern plate. Thereby, the specific design of the pattern may automatically be taken into account in order to optimize fluidisation.

In an embodiment the sand moulding machine includes a control unit adapted to, during at least the filling operation whereby the moulding chamber is being filled with sand through the at least one sand filling opening, open a number of specific fluidisation control valves pertaining to respective groups of compressed air inlet openings so that compressed air is supplied into the moulding chamber through the compressed air inlet openings in such a way that at least 70 percent, preferably at least 80 percent, and most preferred at least 90 percent of the total flow of compressed air through the compressed air inlet openings of the moulding chamber flows into the moulding chamber through compressed air inlet openings located in said lower part of the moulding chamber. Thereby, a suitable upward airflow may be formed in at least a part of the moulding chamber in order to create an at least substantially fluidised bed of sand at least adjacent a part of the chamber bottom wall during at least a part of the filling operation whereby the moulding chamber is being filled with sand through the sand filling opening.

In an embodiment, a number of the compressed air inlet openings are provided with a fluidisation nozzle adapted to limit the airflow. Thereby, it may be ensured that the flow of compressed air into the moulding chamber is more evenly distributed over the number of compressed air inlet openings. By limiting tire airflow through the fluidisation nozzles, the airflow through each nozzle may be more independent of possible varying resistance in respective channels leading to respective fluidisation nozzles. Alternatively, the compressed air inlet openings may simply have a smaller cross-sectional throughput area than that of the channels leading to the compressed air inlet openings.

In an embodiment, a number of the compressed air inlet openings or fluidisation nozzles pertaining to said compressed air inlet openings are directed in an oblique direction relative to the vertical and in the direction of an adjacent pattern plate in order to direct compressed air in the direction of said adjacent pattern plate. Thereby, it may be possible to obtain an even better distribution of sand during the sand filling operation, especially in deeper depressions of the at least one pattern plate.

In an embodiment compressed air inlet openings or fluidisation nozzles located in the chamber bottom wall and preferably also compressed air inlet openings or fluidisation nozzles located in the chamber side walls have the form of ring-formed apertures, and the ring-formed aperture has the form of a ring-formed groove in the relevant chamber wall or in a part inserted flush with the relevant chamber wall or the ring-formed groove is formed between a hole in the relevant chamber wall and a separate element inserted into said hole. A ring-formed aperture may provide less friction against the sand would part than for instance a hole provided with wire mesh during the process of pushing the sand mould part out of the moulding chamber.

In an embodiment the two opposed chamber end walls are both provided with a respective pattern plate having a pattern, a first group of the compressed air inlet openings or fluidisation nozzles pertaining to said compressed air inlet openings are directed in an oblique direction relative to the vertical and in the direction of a first one of the respective two pattern plates in order to direct compressed air in the direction of said first pattern plate, and a second group of the compressed air inlet openings or fluidisation nozzles pertaining to said compressed air inlet openings are directed in an oblique direction relative to the vertical and in the direction of a second one of the respective two pattern plates in order to direct compressed air in the direction of said second pattern plate. Thereby, for a sand moulding machine utilising the vertical sand flaskless moulding technique such as the DISAMATIC, it may be possible to obtain an even better distribution of sand during the sand filling operation, especially in deeper depressions of the pattern plates.

In an embodiment, the sand moulding machine includes a control unit adapted to, by means of at least one pressure reduction valve, control the flow of compressed air from the compressed air source to the compressed air inlet openings. Thereby, it may be possible to better optimise the fluidisation of the sand during the sand filling operation.

In an embodiment, said control unit is adapted to, during at least a part of the filling operation whereby the moulding chamber is being filled with sand, control said flow of compressed air so that the compressed air enters the chamber with a vertical velocity averaged over the area of the chamber bottom wall of between 0.4 and 7 metres per second, preferably of between 0.6 and 5 metres per second and most preferred of between 0.8 and 3 metres per second.

Thereby, it may be possible to obtain an optimal fluidisation of the sand during the sand lifting operation.

In an embodiment, the sand moulding machine includes a control unit, the control unit is adapted to control a sand feed control valve adapted to control a flow of compressed air from the compressed air source to the sand feed system, the control unit is adapted to control at least one fluidisation control valve adapted to control the flow of compressed air from the compressed air source to at least a number of the compressed air inlet openings in the at least one of the chamber walls, the control unit is adapted to open the sand feed control valve and thereby initiate the filling operation whereby the moulding chamber is being filled with sand through the at least one sand filling opening, and the control unit is adapted to open the at least one fluidisation control valve simultaneously with, at least substantially simultaneously with, before or after the opening of the sand feed control valve. Thereby, it may be ensured that the fluidisation of sand entering the moulding chamber is initiated so that as much as possible of the sand distributes over the entire horizontal cross-section of the moulding chamber and does not pile up in a central area. By opening the at least one fluidisation control valve after the opening of the sand feed control valve, it may be taken into account that the sand may start to enter the moulding chamber with some delay in relation to the opening of the sand feed control valve. Thereby, compressed air may be saved and wear may be reduced.

In an embodiment, the control unit is adapted to close the at least one fluidisation control valve when at least ⅓ of the volume of, preferably at least ½ of the volume of and most preferred between ½ and ¾ of the volume of the moulding chamber is filled with sand. Thereby, the fluidisation of the sand may be terminated when a last part of the moulding chamber is to be filled with sand. Consequently, it may be ensured that sand in the lower part of the moulding chamber to some extent starts compacting before the last part of the moulding chamber is filled with sand so that the moulding chamber may be completely filled. It should be noted that when the at least one fluidisation control valve is closed, the volume of the sand in the moulding chamber may typically be reduced with 10 to 20, or about 15, percent of the sand volume as a result of the termination of the fluidisation.

In an embodiment, the control unit is adapted to close the sand feed control valve approximately when the moulding chamber is filled with sand, the sand filling period is the time between the opening and closing of the sand feed control valve, and the control unit is adapted to close the at least one fluidisation control valve when at least ⅓, preferably at least ½ and most preferred between ½ and ¾ of the sand filling period has elapsed. Thereby, the fluidisation of the sand may be terminated when a last part of the moulding chamber is to be filled with sand, and it may be ensured that sand in the lower part of the moulding chamber to some extent starts compacting before the last part of the moulding chamber is filled with sand so that the moulding chamber may be completely fitted.

In an embodiment, the control unit is adapted to close the at least one fluidisation control valve after the moulding chamber has been filled with sand and possibly during or after mechanical compaction of the sand by displacement of a chamber end wall. Thereby, fluidisation of the sand may continue during the entire sand filling operation and possibly during mechanical compaction. Under some circumstances, this may be advantageous in that it may be obtained that the sand flows like a liquid into deep pockets of the pattern of the pattern plate even during mechanical compaction and thereby an improved density in critical regions of the sand mould may be achieved.

In an embodiment, at least some of the compressed air inlet openings have the additional function of air vent nozzles, and at least some or all of the fluidisation control valves have the form of three-way valves enabling the additional vent function and/or separate vent control valves are connected to the compressed air inlet openings. Thereby, some of said compressed air inlet openings may be open for vent air during the subsequent mechanical compaction operation in order to contribute to adequate venting during mechanical compaction.

The present invention further relates to a method of producing moulds, whereby a moulding chamber during a filling operation is filled with sand by means of a send feed system, and whereby the sand is subsequently compacted, the moulding chamber being formed by a chamber top wall, a chamber bottom wall, two opposed chamber side walls and two opposed chamber end walls, whereby the moulding chamber is filled with sand through at least one sand filling opening provided in at least one chamber wall and communicating with the sand feed system, whereby a mould or mould part is provided with a pattern by means of at least one of the chamber end walls being provided with a pattern plate having a pattern, whereby sand is compacted inside the moulding chamber by displacing at least one of the chamber end walls, an at least substantially fluidised bed of sand is created at least adjacent a part of the chamber bottom wall during at least a part of the filling operation when the moulding chamber is being filled with sand through the at least one sand filling opening, whereby the fluidised bed of sand is created by injection of compressed air into the moulding chamber in such a way that an upward airflow in at least a part of the moulding chamber is achieved, whereby the compressed air is injected through a number of compressed air inlets being provided at a lower part of the moulding chamber, whereby a number of or alt of the compressed air inlet openings ore arranged in a number of different groups, and whereby the supply of compressed air to the compressed air inlet openings belonging to a specific group is regulated by means of a specific fluidisation control valve pertaining to said group.

The method is characterised by that the compressor air inlet openings belonging to a specific group are arranged in a corresponding specific area of the chamber bottom wall and/or of the chamber side walls, and by that a number of said specific areas including compressed air inlet openings belonging to respective specific groups are arranged following each other in the direction from a first chamber end wall to a second chamber end wall. Thereby, the above described features may be obtained.

In an embodiment, the fluidised bed of sand is created by injection of compressed air into the moulding chamber in an upward direction. Thereby, the above described features may be obtained.

In an embodiment, compressed air is injected through a number of compressed air inlet openings distributed over at least a central area of the chamber bottom wall. Thereby, the above described features may be obtained.

In an embodiment, compressed air is injected through a number of compressed air inlet openings distributed over at least a peripheral area of the chamber bottom wall. Thereby, the above described features may be obtained.

In an embodiment, compressed air is injected through a number of compressed air inlet openings distributed over at least an area of the chamber bottom wall which is not covered by a projection of the pattern of a pattern plate onto the chamber bottom wall. Thereby, the above described features may be obtained.

In art embodiment compressed air is injected through a number of compressed air inlet openings distributed over at least an area of the chamber bottom wall which is covered by a projection of the pattern of a pattern plate onto the chamber bottom wall.

In an embodiment, at least one of the chamber end walls is associated with an air cushion transport system including a number of slide shoes which are supplied with compressed air and which slide on the chamber bottom waif during displacement of said at least one chamber end wall, and whereby compressed air is injected through a number of compressed air inlet openings distributed over an area of the chamber bottom wall which is not contacted by the slide shoes during displacement of said at least one chamber end wall.

In an embodiment, compressed air is injected through a number of compressed air inlet openings distributed evenly or at least substantially evenly over at least a central area of the chamber bottom wall. Thereby, the above described features may be obtained.

In an embodiment, compressed air is injected through a number of compressed air inlet openings arranged along a lower edge of at least one of the chamber side walls. Thereby, the above described features may be obtained.

In an embodiment, compressed air is injected through a number of compressed air inlet openings arranged along a lower edge of at least one of the chamber end walls. Thereby, the above described features may be obtained.

In an embodiment, compressed air is injected through a number of compressed air inlet openings arranged along a lower edge of both the chamber side walls. Thereby, the above described features may be obtained.

In an embodiment compressed air is injected through a number of compressed air inlet openings arranged along a lower edge of one of the chamber side walls, and whereby air is vented from the moulding chamber through a number of air vent nozzles arranged at an upper part of the other opposed chamber side wall. Thereby, the above described features may be obtained.

In an embodiment, air is vented from the moulding chamber through a number of air vent nozzles provided in at least one of the chamber side walls and/or the chamber top wall and arranged in a number of different groups, and whereby a specific air vent control valve pertaining to a specific group regulates a flow of vent air from the air vent nozzles belonging to said group. Thereby, the above described features may be obtained.

In an embodiment, the air vent nozzles belonging to a specific group are arranged in a corresponding specific area of the chamber side wall and/or of the chamber top wall. Thereby, the above described features may be obtained.

In an embodiment, the air vent nozzles belonging to a specific group are arranged in a corresponding specific area of the chamber side wall, and a number of said specific areas including air vent nozzles belonging to respective specific groups are arranged following each other in a vertical direction. Thereby, the above described features may be obtained.

In an embodiment, compressed air is injected through a number of compressed air inlet openings arranged in an area extending not more than 20 percent, preferably not more than 15 percent and most preferred not more than 10 percent of the height of the chamber side walls from a lower edge of the chamber side walls. Thereby, the above described features may be obtained.

In an embodiment, the supply of compressed air to a number of or all of the compressed air inlet openings located in said lower part of the moulding chamber is regulated by means of a fluidisation control valve. Thereby, the above described features may be obtained.

According to the invention, a number of or all of the compressed air inlet openings are arranged in a number of different groups, end the supply of compressed air to the compressed air inlet openings belonging to a specific group is regulated by means of a specific fluidisation control valve pertaining to said group. Thereby, the above described features may be obtained.

According to the invention, the compressed air inlet openings belonging to s specific group are arranged in a corresponding specific area of the chamber bottom wall and/or of the chamber side walls. Thereby, the above described features may be obtained.

According to the invention, a number of said specific areas including compressed air inlet openings belonging to respective specific groups are arranged following each other in the direction from a first chamber end wall to a second chamber end wall Thereby, the above described features may be obtained.

In an embodiment, the sand moulding machine includes a control unit, and, during the filling operation whereby the moulding chamber is being filled with sand through the at least one sand filling opening, the control unit controls a number of specific fluidisation control valves pertaining to respective groups of compressed air inlet openings to open so that compressed air is supplied into the moulding chamber through a number of the compressed air inlet openings distributed over a specific area of the chamber bottom wall. Thereby, the above described features may be obtained.

In an embodiment, said specific area of the chamber bottom wall is an area located between the chamber end walls during the sand filling operation. Thereby, the above described features may be obtained.

In an embodiment, said specific area of the chamber bottom wall is an area depending on the specific design of the pattern of the at least one pattern plate. Thereby, the above described features may be obtained.

In an embodiment, the sand moulding machine includes a control unit, and whereby, during the filling operation whereby the moulding chamber is being filled with sand through the at least one sand filling opening, the control unit controls a number of specific fluidisation control valves pertaining to respective groups of compressed air inlet openings to open so that compressed air is supplied into the moulding chamber through the compressed air inlet openings in such a way that at least 70 percent, preferably at least 80 percent, and most preferred at least 90 percent of the total flow of compressed air through the compressed air inlet openings of the moulding chamber flows into the moulding chamber through compressed air inlet openings located in said lower part of the moulding chamber. Thereby, the above described features may be obtained.

In an embodiment, the airflow of the compressed air supplied into the moulding chamber through a compressed air inlet opening is limited by means of a fluidisation nozzle. Thereby, the above described features may be obtained.

In an embodiment, the compressed air supplied into tire moulding chamber through a number of compressed air inlet openings or fluidisation nozzles pertaining to said compressed air inlet openings is directed in the direction of an adjacent pattern plate. Thereby, the above described features may be obtained.

In an embodiment, the two opposed chamber end walls are both provided wish a respective pattern having a pattern, the compressed air supplied into the moulding chamber through a first group of the compressed air inlet openings or fluidisation nozzles pertaining to said compressed air inlet openings is directed in an oblique direction relative to the vertical and in the direction of a first one of the respective two pattern plates, and the compressed air supplied into the moulding chamber through a second group of the compressed air inlet openings or fluidisation nozzles pertaining to said compressed air inlet openings is directed in an oblique direction relative to the vertical and in the direction of a second one of the respective two pattern plates. Thereby, the above described features may be obtained.

In an embodiment the sand moulding machine includes a control unit which by means of at least one pressure reduction valve controls the flow of compressed air from the compressed air source to the compressed air inlet openings. Thereby, the above described features may be obtained.

In an embodiment, said control unit, during at least a part of the filling operation whereby the moulding chamber is being filled with sand, controls said flow of compressed air so that the compressed air enters the chamber with a vertical velocity averaged over the area of the chamber bottom wall of between 0.4 and 7 metres per second, preferably of between 0.6 and 5 metres per second and most preferred of between 0.8 and 3 metres per second. Thereby, the above described features may be obtained.

In an embodiment, the sand moulding machine includes a control unit, the control unit controls a sand feed control valve controlling a flow of compressed air from the compressed air source to the sand feed system, the control unit controls at least one fluidisation control valve controlling the flow of compressed air from the compressed air source to at least a number of the compressed air inlet openings in the at least one of the chamber walls, the control unit opens the sand feed control valve and thereby initiates the filling operation whereby the moulding chamber is being filled with sand through the at least one sand filling opening, and the control unit opens the at least one fluidisation control valve simultaneously with, at least substantially simultaneously with, before or after opening the sand feed control valve. Thereby, the above described features may be obtained.

In an embodiment, the control unit closes the at least one fluidisation control valve when at least ⅓ of the volume of, preferably at least ½ of the volume of and most preferred between ½ and ¾ of the volume of the moulding chamber has been filled with sand. Thereby, the above described features may be obtained.

In an embodiment, the control unit closes the sand feed control valve approximately when the moulding chamber has been filled with sand, the sand filling period is the time between the opening and dosing of the sand feed control valve, and the control unit closes the at least one fluidisation control valve when at least ⅓, preferably at least ½ and most preferred between ½ and ¾ of the sand filling period has elapsed. Thereby, the above described features may be obtained.

In an embodiment, the control unit closes the sand feed control valve after the moulding chamber has been filled with sand and possibly during or alter mechanical compaction of the sand by displacement of a chamber end wall. Thereby, the above described features may be obtained.

In an embodiment, compressed air inlet openings or fluidisation nozzles located in the chamber bottom wall and preferably also compressed air inlet openings or fluidisation nozzles located in the chamber side walls have the form of ring-formed apertures, and the ring-formed aperture has the form of a ring-formed groove in the relevant chamber wall or in a part inserted flush with the relevant chamber wall or the ring-formed groove is formed between a hole in the relevant chamber wall and a separate element inserted into said hole. Thereby, the above described features may be obtained.

In an embodiment, during at least a part of the sand filling operation and/or during at least a part of the mechanical compacting operation, air is vented from the moulding chamber through at least some of the compressed air inlet openings, and whereby at least sense or all of the fluidisation control valves have the form of three-way valves and control the vent air through said compressed air inlet openings and/or whereby separate vent control valves control the vent air through said compressed air inlet openings. Thereby, the above described features may be obtained.

Figure 2:
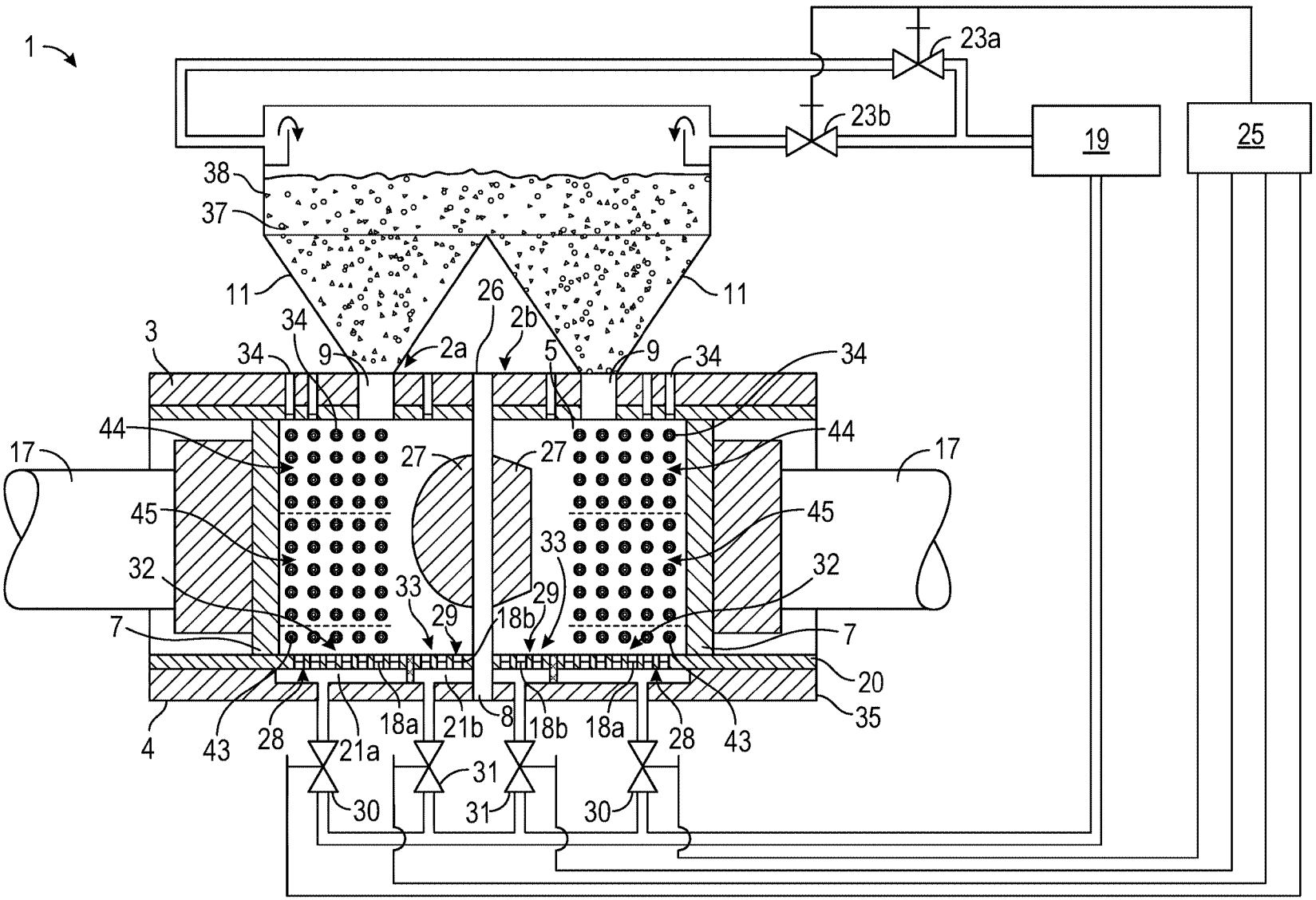

The invention will now be explained in more detail below by means of examples of embodiments with reference to the very schematic drawing, in which FIG. 1 is a lateral cross-sectional view of part of a DISAMATIC sand moulding machine incorporating the present invention; and FIG. 2 is a later cross-sectional view of part of a DISA MATCH sand moulding machine incorporating an embodiment of the present invention.

FIG. 1 illustrates a part of a sand moulding machine 1 according to the present invention. The illustrated machine according to this embodiment of the invention is a DISAMATIC (Registered Trademark) vertical flaskless sand moulding machine. The sand moulding machine 1 includes a moulding chamber 2 formed by a chamber top wall 3, a chamber bottom wall 4, two opposed chamber side walls 5 (of which only one is visible) and two opposed chamber end walls 7, 8. The chamber top wall 3 is provided with a sand filling opening 9 communicating with a sand feed system 10 of which only a funnel 11 and a sand container 38 arranged on top of the funnel 11 are shown. The sand filling opening 9 is typically an elongated opening or a slot extending in the direction between the two opposed chamber side walls 5. Both chamber end walls 7, 8 are provided with a pattern plate 12, 13 having a pattern 14, 15. The chamber end walls 7, 8 are in a well-known manner arranged displaceably in the direction against each other in order to compact sand fed into the moulding chamber. As seen, the first chamber end wall 7 to the left in FIG. 1 is arranged swingable about a pivot axis 16 in order to open the moulding chamber 2 when a produced sand mould part (not shown) has to be expelled from the moulding chamber. The pivot axis 16 is furthermore in a well-known manner arranged to be displaceable in a longitudinal direction of the moulding chamber 2 so that the first chamber end wall 7 may be displaced to the left in the figure and subsequently tilted about the pivot axis 16 by means of a lifting arm 39 pivotally 40 connected to the end wall 7 so that the end wall 7 is located at a level above a produced sand mould part, so that the sand mould part may be expelled from the moulding chamber 2. The produced sand mould part may be expelled from the moulding chamber 2 by means of a piston 17 arranged to displace the second chamber end wall 8. Thereby, the produced sand mould parts may in a well-known manner be arranged in a row in mutually abutting relationship on a not shown conveyor. In this way, two adjacent sand mould parts may form a complete sand mould for a casting.

Typically, the chamber end walls 7, 8 and possibly the chamber bottom wall 4 may in a well-known manner be provided with heating elements, such as electric heating elements, in order to maintain the patterns at a minimum temperature, such as for instance 5 degrees Celsius higher than the temperature of the sand. Thereby, it may be prevented that humidity in the sand condensates and/or causes the sand to stick to the patterns, for instance as a result of expanding compressed air providing a cooling effect in the moulding chamber, as further explained below or due to hot moulding sand due to the fact that moulding sand normally is reused in a practically closed loop.

In the embodiment illustrated in FIG. 1, the chamber bottom wall 4 is provided with a number of compressed air inlet openings 18 connected to a compressed air source 19 in the form of a compressed air tank for the delivery of compressed air into the moulding chamber 2. The compressed air tank is in a well-known manner supplied with compressed air from a not shown compressor. In this way, all of the compressed air inlet openings 18 of the moulding chamber 2 are located in a lower part of the moulding chamber 2, and they are adapted to direct air in an upward direction. Thereby, the compressed air inlet openings 18 are arranged to form an upward airflow in at least a part of the moulding chamber 2 in order to create an at least substantially fluidised bed of sand at least adjacent a part of the chamber bottom wall 4 during at least a part of a filling operation whereby the moulding chamber 2 is being filled with sand through the sand filling opening 9. A suitable arrangement of the compressed air inlet openings 18 in order to create such a fluidised bed of sand may be obtained by arranging such a number of compressed air inlet openings 18 per area and arranging the compressed air inlet openings 18 with such a cross-sectional throughput area that an at least substantially fluidised bed of sand may be obtained by an adequate input pressure of the compressed air fed to the compressed air inlet openings 18. In the embodiment illustrated in FIG. 1, said suitably arrangement of the compressed air inlet openings 18 in order to create such a fluidised bed of sand has been obtained by arranging all of the compressed air inlet openings 18 of the moulding chamber 2 in a lower part of the moulding chamber 2. However, of course, said suitable arrangement could additionally include some compressed air-inlet openings 18 arranged in other parts of the moulding chamber, for instance in a top part, as long as the total effect of the arrangement is that an upward airflow may be created in at least a part of the moulding chamber 2 and said fluidised bed of sand may thereby be obtained. This total effect may for instance be obtained by arranging all of the compressed air inlet openings 18 of the moulding chamber 2 so that at least 70 percent, preferably at least 80 percent, and most preferred at least 90 percent of the total throughput area of the compressed air inlet openings 18 of the moulding chamber 2 is located in said lower part of the moulding chamber. In the illustrated embodiment, the compressed air inlet openings 18 are formed in the inside of the chamber bottom wall 4 through an inner part 20 of the chamber bottom wall 4 and communicate with a manifold 21 termed as a cavity in an outer part 35 of the chamber bottom wall 4. An inlet 24 of the manifold 21 is connected to the compressed air source 19 via a fluidisation control valve 22. The manifold 21 may be formed or arranged differently than illustrated.

The compressed air source 19 may be associated with a not shown heating system and heating control system in order to heat the compressed air supplied from the compressed air source 19. Thereby, it may be avoided that the compressed air supplied provides a cooling effect in the moulding chamber as the air expends. Furthermore, the compressed air source 19 may be associated with a not shown system for humidification of the fluidisation air in order to avoid that the sand may dry too much.

A control unit 25 is adapted to control the fluidisation control valve 22. Furthermore, the control unit 25 is adapted to control a sand feed control valve 23 adapted to control a flow of compressed air from the compressed air source 19 to the sand container 38 of the sand feed system 10. Compressed air from the sand feed control valve 23 may thereby be fed into the sand container 38 at a level over the top level of the sand 37 located in the funnel 11 and the sand container 38. Thereby, the sand filling operation whereby the moulding chamber 2 is filled with sand from the sand feed system 10 through the sand filling opening 9 may be controlled in a well-known manner. During the sand filling operation, sand provided in the funnel 11 and sand container 38 is so to say "shot" into the moulding chamber 2 through the sand filling opening 9 by closing the top of the sand container 38 and opening the sand feed control valve 23 so that compressed air presses the sand 37 down through the sand filling opening 9. When the sand filling operation (the "shot") has been completed, the air pressure in the funnel 11 and sand container 38 is relieved by means of a not shown air vent valve. Subsequently, the sand present in the moulding chamber 2 is compacted by displacement of the first chamber end wall 7 and/or the piston 17 with the second chamber end wall 8 so that a sand mould part is formed. When a produced sand mould part is expelled from the moulding chamber 2, an amount of compacted sand is still closing the sand filling opening 9 until the next "shot" of sand enters the moulding chamber through the sand filling opening 9. The sand filling operation (a "shot") may typically take about 0.8 to 1.5 seconds. The pressure of the compressed air provided in the funnel 11 and sand container 38 during the sand filling operation may typically be approximately 2 to 4 bars. The compressed air is provided via the sand feed control valve 23 which normally is an on/off valve. Alternatively, the sand feed control valve 23 may have the form of a number of on/off valves, for stepwise control of the flow rate of compressed air to the sand feed system 10.

In order to create a suitable at least substantially fluidised bed of sand, a number of the compressed air inlet openings 18 may be distributed over at least a central area of the chamber bottom wall 4. Thereby, sand entering the moulding chamber 2 through the sand filling opening 9 may be fluidised and thereby better distribute over the entire area of the chamber bottom wall 4 and further into deeper depressions or deep pockets in the pattern plate 12, 13 as illustrated in FIG. 1. In fact, the fluidisation of the sand may cause the sand to flow like water into said deeper depressions or deep pockets 41. This is due to the fact that when the sand is fluidised, a static pressure in the fluidised sand comparable to the hydrostatic pressure in water may urge sand to flow into openings such as pockets of the pattern. Such deeper depressions or deep pockets 41 in the pattern plate 12, 13 are typically provided with dedicated air vent nozzles 42 as also illustrated in FIG. 1. Such dedicated air vent nozzles 42 may communicate with the surroundings via not shown channels formed in the chamber end walls 7, 8 and/or pattern plates 12, 13 in order to prevent that pockets of air is formed in said deeper depressions or deep pockets 41 in the pattern plate 12, 13. However, generally, in prior art sand moulding machines, the provision of said dedicated air vent nozzles 42 may only to some extend improve sand filling of the deeper depressions or deep pockets 41 in the pattern. Furthermore, it is known to connect said dedicated air vent nozzles 42 to a vacuum source. However, generally, this may only improve sand filling of the deeper depressions or deep pockets 41 in the pattern plate marginally. On the contrary, according to the present invention, it has been found that the fluidisation of the sand may cause the sand to flow like water into said deeper depressions or deep pockets 41 and thereby improve sand filling of the deeper depressions or deep pockets 41 in the pattern plate substantially. Normally, without said fluidisation of the sand, the sand would start piling up at a central area of the chamber bottom wall 4. By a fluidised bed of sand is understood that the sand is influenced by an upward air flow so that the sand is able to flow in an at least substantially fluid-like way. Preferably, as illustrated in FIG. 1, a number of the compressed air inlet openings 18 are distributed over at least an area of the chamber bottom wall 4 which is not covered by a projection of the pattern 14, 15 of the respective pattern plates 12, 13 onto the chamber bottom wall 4. Thereby, sand entering the sand filling opening 9 in the chamber fop wall 3 and being poured directly vertically down through the moulding chamber 2 may effectively be fluidised instead of starting piling up at a central area of the chamber bottom wall.

The number of the compressed air inlet openings 18 may be distributed evenly or at least substantially evenly over at least a central area of the chamber bottom wall 4. However, other configurations are also possible. For instance, the number of the compressed air inlet openings 18 may be distributed with a relatively higher density (holes per area) in a central area of the chamber bottom wall 4 and with a relatively lower density (holes per area) in an area surrounding said central area of the chamber bottom wall 4. This may facilitate a transport of fluidised sand from said central area to said surrounding or peripheral area of or above the chamber bottom wall 4. Alternatively or additionally, the number of the compressed air inlet openings 18 may be arranged with a relatively larger effective throughput area of each compressed air inlet opening 18 in a central area of the chamber bottom wall 4 and with a relatively smaller effective throughput area of each compressed air inlet opening 18 in an area surrounding said central area of the chamber bottom wall 4. This may oven better facilitate a transport of fluidised sand from said central area to said surrounding or peripheral area of or above the chamber bottom wall 4.

Additionally or alternatively to the arrangement of compressed air inlet openings 18 in the chamber bottom wall 4, a number of compressed air inlet openings 43 may be arranged along a tower edge of at least one of the chamber side walls 5. Thereby, a suitable fluidisation of sand entering vertically down through the moulding chamber 2 may be achieved even without compressed air inlet openings 18 in the chamber bottom wall 4 or the effect of compressed air inlet openings 18 in the chamber bottom wall 4 may be improved by or at least supplemented by the effect of compressed air inlet openings 43 arranged along a lower edge of the chamber side walls 5. By means of a number of compressed air inlet openings 43 arranged along a lower edge of the chamber side walls an upward air flow may be created in the moulding chamber more or less independently of the direction in which the compressed air inlet openings 43 open into the moulding chamber. Said upward air flow may create a suitable fluidised bed of sand so that the sand is able to flow in an at least substantially fluid-like or liquid-like way. This embodiment may be advantageous in a typical embodiment of a sand mould machine, wherein at least one of the chamber end walls 7, 8 is associated with a not shown air cushion transport system including a number of slide shoes supplied with compressed air and adapted to slide on the chamber bottom wall 4 during displacement of said at least one chamber end wall 7, 8. The provision of compressed air inlet openings 18 in the area of the chamber bottom wall 4 where such slide shoes slide on the chamber bottom wall 4 would generally drastically reduce the function of the slide shoes. Suitably, a number of or all of the compressed air inlet openings 43 of the chamber walls 3, 4, 5, 7, 8 may be arranged in an area extending not more than 20 percent, preferably not more than 15 percent and most preferred not more than 10 percent of the height of the chamber side walls 5 from a lower edge of the chamber side walls 5.

Furthermore, additionally or alternatively to the arrangement of compressed air inlet openings 18 in the chamber bottom wall 4, 8, a number of the compressed air inlet openings 43 may be arranged along a lower edge of at least one of the chamber end walls 7, 8. Thereby, fluidisation may be obtained next to the pattern plate. This may be advantageous, for instance in the case of a pattern with deep pockets, i.e. a so-called negative pattern. Furthermore, said number of the compressed air inlet openings may thereby be arranged in the pattern plate and the specific arrangement may therefore be adapted to the specific pattern of the pattern plate so that the arrangement of the compressed air inlet openings is also changed when the pattern plate is changed. Suitably, a number of compressed air inlet openings 43 may be arranged in an area extending not more than 20 percent, preferably not more than 13 percent and most preferred not more than 10 percent of the height of the chamber end walls 7, 8 from a tower edge of the chamber end walls 7, 8.

The fluidisation control valve 22 is adapted to regulate the supply of compressed air to the compressed air inlet openings 18. Thereby, the fluidisation of sand entering the moulding chamber 2 may be optimised in that the air How rate may be adjusted appropriately during fluidisation and/or a start and an end time for the fluidisation may be adjusted relatively to the sand filling operation in order to optimise the sand filling of the moulding chamber 2. The fluidisation pressure, i.e. the inlet pressure for the compressed air inlet openings 18, may in this way be adjusted as a function of the pressure in the funnel 11 of the sand feed system 10 during a sand filling operation. The fluidisation control valve 22 may be a flow rate control valve adapted to open or close and control the How rate through the valve. Alternatively, the fluidisation control valve 22 may have the form of an on/off valve possibly in combination with a pressure reduction valve controlled by the control unit 25. Alternatively, the fluidisation control valve 22 may have the form of a number of on/off valves for stepwise control of the flow rate of compressed air to the compressed air inlet openings 18. A separate not shown fluidisation control valve corresponding to the fluidisation control valve 22 may be adapted to regulate the supply of compressed air to the compressed air inlet openings 43 arranged along a lower edge of at least one of the chamber side walls 5.

By fluidising the sand over the chamber bottom wall 4 during the tilling operation, the sand may more easily flow into lower and/or deeper areas of the pattern 14, 15 of the pattern plate 12, 13. Moreover, the effect of the fluidisation of the sand in combination with the effect of the additional air in-flow to the moulding chamber 2 provided by the fluidising air may cause the sand to flow as liquid in the direction of deeper depressions or deep pockets 41 of the pattern plate 12, 13 provided with air vent nozzles 42 which will be described in further detail below. Consequently, a more even hardness and strength throughout the produced sand moulds may be achieved as a result of an improved pre-compaction during the sand filling operation. Therefore, a higher precision of the metal product subsequently casted in the sand mould may therefore be achieved due to minimised deformation of the sand mould. Furthermore, a higher quality of the surface of the casted product may be achieved due to reduced penetration of liquid metal into the sand mould during the casting process.

As mentioned above, the sand feed pressure of the compressed air provided in the funnel 11 and sand container 38 during the sand filling operation may typically be approximately 2 to 4 bars. However, in certain situations, it may be preferred that this pressure is in the lower part of this range or below, such as only about 2 bars, in order to achieve better forming of the produced sand mould parts and/or in order to reduce wear on machine parts. By fluidising the sand by means of compressed air provided through compressed air inlet openings 18, 43 at the bottom of the moulding chamber 2, sufficient sand transport into deeper depressions or deep pockets 41 of the pattern plates may be achieved overs with a reduced sand feed pressure of only about 2 bars. Therefore, according to the present invention, it may be preferred that the sand feed pressure is less than 2.5 bars and maybe even less than 2 bars.

In addition, by fluidising the sand at the chamber bottom wall 4 during the filling operation, the sand may more easily flow into peripheral regions 36 of the moulding chamber 2 positioned at the chamber end walls 7, 8, below the pattern 14, 15 of the pattern plate 12, 13 and next to the chamber bottom wall 4. Thereby, a greater hardness of the compacted sand of the produced sand mould may be obtained in such peripheral regions 36. Consequently, the pattern 14, 15 in the moulding chamber 2 may be arranged closer to such peripheral regions 36 thereof. The corresponding regions of the produced sand moulds may even be utilised for smaller cavities for the subsequent casting of details of the final product. In fact, the region of the moulding chamber 2 available for the pattern 14, 15 of the pattern plate 12, 13 may therefore become larger in its extension towards the chamber bottom wall 4. Therefore, a greater metal casting capacity may be achieved for existing plants.

FIG. 2 illustrates a part of another embodiment of the sand moulding machine 1 according to the present invention. The illustrated machine according to this embodiment of the invention is a DISA MATCH (Registered Trademark) horizontal flaskless match plate moulding machine. Elements of this embodiment corresponding to elements of the embodiment described above are referred to by the same reference numerals. This embodiment of the sand moulding machine 1 includes a first moulding chamber 2*a* and a second moulding chamber 2*b* separated by a match plate 26 in a well-known manner. The match plate 26 forms a pattern plate and is provided with a pattern 27 on either side. However, the match plate 26 may in some embodiments be provided with a pattern 27 on only one side. Referring to the first moulding chamber 2*a*, the moulding chamber 2*a* is formed by a chamber top wall 3, a chamber bottom wall 4, two opposed chamber side walls 5 and two opposed chamber end walls 7, 8. The chamber and wall 8 is formed by the match plate 26 provided with the pattern 27. The first chamber end wall 7 is in a well-known manner arranged displaceably by means of the piston 17 in the direction against the first chamber end wall 8 formed by the match plate 26 in order to compact sand fed into the moulding chamber 2. The second moulding chamber 2*b* is formed correspondingly.

In the embodiment illustrated in FIG. 2, the compressed air inlet openings 18*a*, 18*b* belonging to the moulding chamber 2*a* are arranged in two different groups 28, 29. Each group 28, 29 may include one or several compressed air inlet openings 18*a*, 18*b*. The compressed air inlet openings 18*a* belonging to the first group 28 are communicating with a manifold 21*a* connected to the compressed air source 19 via a first specific fluidisation control valve 30 pertaining to the first group 28 and adapted to regulate the supply of compressed air to the compressed air inlet openings 18*a* belonging to the first group 28. The compressed air inlet openings 18*b* belonging to the second group 29 are communicating with a manifold 21*b* connected to the compressed air source 19 via a second specific fluidisation control valve 31 pertaining to the second group 29 and adapted to regulate the supply of compressed air to the compressed air inlet openings 18*b* belonging to the second group 29. Similarly, the compressed air inlet openings 18*a*, 18*b* belonging to the moulding chamber 2*b* are arranged in two different groups 28, 29 and communicate with a first specific fluidisation control valve 30 and a second specific fluidisation control valve 31, respectively, the first and second specific fluidisation control valves 30, 31 relating to the moulding chambers 2*a*, 2*b*, respectively, may all be controlled individually according to individual needs. Thereby, the total inflow of compressed air for fluidisation of sand may be adjusted and a larger or smaller area over the chamber bottom wall 4 may be fluidised in order to optimise the sand filling of each of the individual moulding chambers 2*a*, 2*b*.

The first and second specific fluidisation control valves 30, 31 may be flow rate control valves adapted to open or close and control the flow rate through the valves. Alternatively, first and second specific fluidisation control valves 30, 31 may have the form of an on/off valve possibly in combination with a pressure reduction valve controlled by the control unit 25. Alternatively, first and second specific fluidisation control valves 30, 31 may have the form of a number of on/off valves for stepwise control of the flow rate of compressed air to the compressed air inlet openings 18*a*, 18*b*. Thereby, different pressures may be applied to compressed air inlet openings 18*a*, 18*b* belonging to different groups 28, 29, respectively.

As seen in this embodiment, the compressed air inlet openings 18*a*, 18*b* belonging to a specific group 28, 29 are arranged in a corresponding specific area 32, 33 of the chamber bottom wall 4. Thereby, a certain larger or smaller part of the area over the chamber bottom wall 4 may be fluidised in order to optimise the sand filling of the moulding chamber. Dry sand will generally require a relatively reduced air density whereas humid sand will generally require a relatively increased air density. Similarly, in this way, the direction of the injected compressed air may be controlled. If the compressed air inlet openings 18*a* belonging to the first group 28 are directed in one direction, and the compressed air inlet openings 18*b* belonging to the second group 29 are directed in another direction.

As illustrated in FIG. 2, said specific areas 32, 33 including compressed air inlet openings 18*a*, 18*b* belonging to the respective specific groups 28, 29 are arranged following each other in the direction from the first chamber end wall 7 to the second chamber end wall 8. Thereby, a larger or smaller part of the area over the chamber bottom wall 4 may be fluidised depending an the distance between the first and second chamber end walls 7, 8 during the sand filling operation. However, said specific areas 32, 33 could also be arranged differently in relation to each other, for instance coaxially. Any suitable number of specific areas could be employed.

Therefore, in the embodiment illustrated in FIG. 2, the control unit 25 may be adapted to, during the sand filling operation, open a number of specific fluidisation control valves 30, 31 pertaining to respective groups 28, 29 so that compressed air is supplied into the moulding chamber 2*a* through a number of the compressed air inlet openings 18*a*, 18*b* distributed over at least an area of the chamber bottom wall 4 which is not covered by a projection of the pattern 27 of the pattern plate 8 onto the chamber bottom wall 4. Thereby, a larger or smaller part of the area over the chamber bottom wall 4 may be fluidised depending on the distance between the first and second chamber end walls 7, 8 during the sand filling operation, so that sand entering a sand filling opening in the chamber top wall 3 and being poured directly vertically down through the moulding chamber 2 may effectively be fluidised instead of starting piling up at a central area of the chamber bottom wall 4. In the embodiment illustrated in FIG. 2, a separate not shown fluidisation control valve corresponding to the fluidisation control valves 30, 31 may be adapted to regulate the supply of compressed air to the compressed air inlet openings 43 arranged along a lower edge of at least one of the chamber side walls 5.

Naturally, the arrangement of the compressed air inlet openings 18*a*, 18*b* belonging to the moulding chamber 2*a* in two different groups 28, 29 as illustrated in the embodiment illustrated in FIG. 2 may likewise be applied to the embodiment illustrated in FIG. 1, Any suitably number of groups may be applied.

In the different embodiments, the compressed air inlet openings 18, 18*a*, 18*b*, 43 may be provided with a not shown fluidisation nozzle adapted to limit the airflow. Thereby, it may be ensured that the flow of compressed air into the moulding chamber 2 is more evenly distributed over the number of compressed air inlet openings. By limiting the airflow through the fluidisation nozzles, the airflow through each nozzle may be more independent of possible varying resistance in respective channels leading to respective fluidisation nozzles. Alternatively, the compressed air inlet openings 18, 18*a*, 18*b*, 43 may simply have a smaller cross-sectional throughput area than that of the channels leading to the compressed air inlet openings.

In an embodiment a number of the compressed air inlet openings 43 are arranged along a lower edge of both the chamber side walls 5. Thereby, oppositely directed flows of compressed air may meet between the opposed chamber side walls 5, and a resulting suitable upward airflow may be obtained in at least a part of the moulding chamber 2, 2*a*, 2*b*, thereby creating an at least substantially fluidised bed of sand at least adjacent a part of the chamber bottom wall 4.

In an embodiment, a number of the compressed air inlet openings 43 are arranged along a lower edge of one of the chamber side walls 5, and a number of air vent nozzles 34 are arranged at an upper part of the other opposed chamber side wall. Thereby, as a result of air flowing from said compressed air inlet openings 43 to said air vent nozzles 34, a suitable upward airflow may be obtained in at least a part of the moulding chamber 2, 2*a*, 2*b*, thereby creating an at least substantially fluidised bed of sand at least adjacent a pad of the chamber bottom wall 4. In FIG. 1, such an embodiment is illustrated. In the shown embodiment, the not shown chamber side wall being opposed to the illustrated chamber side wall 5 has an arrangement of compressed air inlet openings 43 and air vent nozzles 34 corresponding to that of the illustrated chamber side wall 5. However, in an alternative embodiment, only one of the chamber side walls 5 is provided with the arrangement of compressed air inlet openings 43 and air vent nozzles 34 illustrated in FIG. 1. The just discussed arrangements of compressed air inlet openings 43 and air vent nozzles 34 may of course also be applied to the embodiment illustrated in FIG. 2.

In an embodiment, at least one of the chamber side walls 5 is provided with a number of air vent nozzles 34 arranged in a number of different groups 44, 45, and the air vent nozzles 34 belonging to a specific group 44, 45 communicate with a not shown specific air vent control valve pertaining to said group 44, 45 and adapted to regulate a flow of vent air from the air vent nozzles 34 belonging to said group. Thereby, the vent air flow from the moulding chamber may be suitably controlled according to specific needs, for instance in dependence of the specific structure of the pattern or patterns 14, 15. The air vent nozzles 34 belonging to a specific group 44, 45 may advantageously be arranged to a corresponding specific area of the chamber side wall 5, and a number of said specific areas including air vent nozzles 34 belonging to respective specific groups 44, 45 may be arranged following each other in a vertical direction. In FIG. 2, such an embodiment is illustrated wherein the specific groups 44, 45 of air vent nozzles 34 are divided by broken lines. Furthermore, the lower arranged groups 45 of air vent nozzles 34 are divided from lower rows of compressed air inlet openings 43, respectively, by broken lines. This arrangement of compressed air inlet openings 43 end air vent nozzles 34 may of course also be applied to the embodiment illustrated in FIG. 1. By this arrangement, for instance, only air vent nozzles 34 arranged relatively high may be open during the sand filling operation, in order to achieve a suitable upward airflow in at least a pan of the moulding chamber 2, 2*a*, 2*b* in order to create an at least substantially fluidised bed of sand, whereas also lower located air vent nozzles 34 may be open during the subsequent mechanical compaction operation in order to ensure adequate venting during mechanical compaction. Furthermore, for instance, by opening only air vent nozzles 34 arranged relatively high during the sand filling operation, a fluidised bed of sand may be created over a greater part of the height of the moulding chamber 2, 2*a*, 2*b* when this is desired, for instance when employing a pattern 14, 15 having predominantly deep depressions 41 over the entire height. On the other hand, for instance, by opening air vent nozzles 34 arranged over substantially the entire height of the moulding chamber 2, 2*a*, 2*b*, during the sand filling operation, a fluidised bed of sand may be crested predominantly in a lower part of the moulding chamber when this is desired, for instance when employing a pattern having deep depressions only at its lower part.

In the different embodiments illustrated in FIGS. 1 and 2, preferably the chamber side walls 5 end chamber top wall 3 are in a manner known per se provided with the above-mentioned air vent nozzles 34 adapted to vent air from the moulding chamber 2 during the sand filling operation. In some cases, even the chamber bottom wall 4 could be provided with air vent nozzles 34. In the embodiment illustrated in FIG. 1, the first chamber end wall 7 and pattern plate 12 is also provided with air vent nozzles 42. The outlet vent passages defined by the air vent nozzles 34, 42 may typically be dimensioned to be small enough in relation to the sand particle size so that substantially all of the sand will remain in the moulding chamber 2. The air vent nozzles 34, 42 may be provided with a wire mesh diaphragm extending across its opening in order to prevent sand from passing. Such an embodiment may typically be preferred for the air vent nozzles 42 provided in deep pockets 41 as this embodiment may provide a relatively high air flow rate. In an embodiment, the air vent nozzles 34, 42 may simply have the form of holes or apertures. Preferably the air vent nozzles 34 form ring-formed apertures, whereby the ring-formed aperture has the form of a ring-formed groove in the relevant chamber wall or in a separate element inserted into the relevant chamber wall. Preferably the ring-formed groove is formed between a hole in the relevant chamber wall and a separate element inserted into said hole. The cross-sectional width of said ring-formed groove is chosen only a little larger than the general sand particle size. For instance the cross-sectional width of said ring-formed groove may be approximately 0.4 millimetres and the general sand particle size may be approximately 0.2 millimetres. This embodiment may be preferred for air vent nozzles 34 arranged in the chamber side walls 5, the chamber bottom wall 4 in particular, and in the chamber top wall 3 due to the fact that the moulded sand mould part may slide against air vent nozzles 34 in such locations during the process of squeezing the sand and pushing the sand mould part out of the moulding chamber. A ring-formed aperture may provide less friction against the sand mould part than for instance a hole provided with wire mesh.

Generally, in addition to the air vent nozzles 42 illustrated in FIG. 1, in the different embodiments illustrated in FIGS. 1 and 2, depressions of the pattern 14, 16, 27 may typically in a manner known per se be provided with air vent nozzles 42, holes or apertures adapted to vent air from the moulding chamber 2 during the sand filling operation and during the subsequent mechanical sand compaction operation. Said air vent nozzles, holes or apertures may be of any of the types described just above and may be arranged in the pattern plate 12, 13 or match plate 26. However, because said air vent nozzles, holes or apertures may be arranged so that they do not slide against the moulded sand mould part when the moulded sand mould part is pushed out of the moulding chamber 2, 2*a*, 2*b*, it may be preferred to form these air vent nozzles, holes or apertures as openings covered by a wire mesh or similar. Thereby, a larger cross-sectional through-flow area may easier be achieved than it may be the case with a ring-formed opening. In this way, sand may be carried by an air stream into those depressions during sand filling and thereby a better filling of those areas may be obtained. Said air vent nozzles, holes or apertures may furthermore be connected to a not shown vacuum source in order to facilitate filling of said areas.

In embodiments wherein the compressed air inlet openings 18, 18*a*, 18*b*, 43 or fluidisation nozzles are located in the chamber bottom wall 4 or chamber side walls 5. It may be preferred that they have the form of ring-formed apertures, whereby the ring-formed aperture has the form of a ring-formed groove in the relevant chamber wall. The cross-sectional width of said ring-formed groove is chosen in dependence of the required air flow and so that substantially all of the sand will remain in the moulding chamber 2. For instance the cross-sectional width of said ring-formed groove could be 0.1 millimetres. A ring-formed groove may be chosen because the moulded sand mould pad may elide against air inlet openings 18, 18*a*, 18*b*, 43 or fluidisation nozzles in such locations during the process of pushing the sand mould part out of the moulding chamber 2, 2*a*, 2*b*. A ring-formed aperture may provide less friction against the sand mould part than for instance a hole provided with wire mesh.

In an embodiment, a number of the compressed air inlet openings 18, 18*a*, 18*b*, 43 or fluidisation nozzles pertaining to said compressed air inter openings are directed in an oblique direction relative to the vertical and in the direction of an adjacent pattern plate 12, 13, 27 in order to direct compressed air in the direction of said adjacent pattern plate. Thereby, it may be possible to obtain an even better distribution of sand during the sand filling operation, especially in deeper depressions of the at least one pattern plate. The compressed air inlet openings 18, 18*a*, 18*b*, 43 or fluidisation nozzles may have the form of ring-formed apertures, whereby the ring-formed aperture has the form of a ring-formed groove in the relevant chamber wall or in a separate element inserted into the relevant chamber wall. Preferably the ring-formed groove is formed between a hole in the relevant chamber wall a separate element inserted into said hole. The ring-formed aperture is directed to an oblique direction relative to the vertical or in the case of a separate element inserted into a hole in the relevant chamber wall, the relative positions and forms of the separate element and the hole may be adapted so that compressed air may be directed out of the ring-formed groove in an oblique direction relative to the vertical. The compressed air may otherwise be directed in a suitable oblique angle by any suitable means.

In the embodiment illustrated in FIG. 1, alternatively, a first group of the compressed air inlet openings 18 or fluidisation nozzles pertaining to said compressed air inlet openings may be directed in an oblique direction relative to the vertical and in the direction of the first pattern plate 12 in order to direct compressed air in the direction of said first pattern plate 12, and a second group of the compressed air inlet openings 18 or fluidisation nozzles pertaining to said compressed air inlet openings may be directed in an oblique direction relative to the vertical and in the direction of the second pattern plate 13 in order to direct compressed air in the direction of said second pattern plate 13. Thereby, it may be possible to obtain an even better distribution of sand during the sand filling operation, especially in deeper depressions of the pattern plates.

In an embodiment, the control unit 25 is adapted to, during at least a part of the filling operation whereby the moulding chamber 2 is being fifed with sand, by means of the fluidisation control valve or valves 22, 30, 31, control the flow of compressed air so that the compressed air enters the chamber with a vertical velocity averaged over the area of the chamber bottom wall of between 0.4 and 7 metres per second, preferably of between 0.6 and 5 metres per second and most preferred of between 0.8 and 3 metres per second. Thereby, it may be possible to obtain an optimal fluidisation of the moulding sand during the sand filling operation.

In an embodiment, the control unit 25 is adapted to open the sand feed control valve 23 and thereby initiate and control the filling operation whereby the moulding chamber 2 is being filled with sand through the at least one sand filling opening 9, and the control unit 25 is adapted to open the at least one fluidisation control valve 22, 30, 31 simultaneously with, at least substantially simultaneously with, before or after the opening of the sand feed control valve 23. Thereby, it may be ensured that the fluidisation of sand entering Use moulding chamber 2 is initiated so that as much as possible of the sand distributes over the entire horizontal cross-section of the moulding chamber 2 and does not pile up in a central area. By opening the at least one fluidisation control valve after the opening of the sand feed control valve, it may be taken into account that the sand may start to enter the moulding chamber with some delay in relation to the opening of the sand feed control valve. Thereby, compressed air may be saved.

In an embodiment, the control unit 25 is adapted to close the fluidisation control valve 22, 30, 31 when at least ⅓ of the volume of preferably at least ½ of the volume of and most preferred between ½ and ¾ of the volume of the moulding chamber 2 is filled with sand. Thereby, the fluidisation of the sand may be terminated when a last part of the moulding chamber 2 is to be filled with sand. Consequently, it may be ensured that sand in the lower part of the moulding chamber 2 to some extent starts pre-compacting as fluidisation stops before the last part of the moulding chamber is filled with sand so that the moulding chamber may be completely filled. It should be noted that when the at least one fluidisation control valve is closed, the volume of the sand in the moulding chamber may typically be reduced with 10 to 20, or about 15, percent of the sand volume as a result of the termination of the fluidisation.

For instance, when employing patterns 14, 15 having deep pockets 41 generally only in the lower part of the moulding chamber 2. It may be preferred to close the fluidisation control valve 22, 30, 31 when at least ⅓ of the volume of, or at least ½ of the volume of the moulding chamber 2 is filled with sand.

However, when employing patterns 14, 15 having deep pockets 41 generally ever the entire height of the moulding chamber 2, it may be preferred to close the fluidisation control valve 22, 30, 31 when at least ¾ of the volume of the moulding chamber 2 or the entire volume of the moulding chamber 2 is filled with sand. It may even be preferred to continue fluidisation during at least a part of or during the entire subsequent mechanical compaction of the sand by means of displacement of the first chamber end wall 7 and/or the piston 17 with the second chamber end wall 8.

In an embodiment, the control unit 25 is adapted to close the sand feed control valve 22, 30, 31 approximately when the moulding chamber 2 is filled with sand, the sand filling period is the time the opening and closing of the sand feed control valve 22, 30, 31, and the control unit 25 is adapted to close the fluidisation control valve 22, 30, 31 when at least ⅓, preferably at least ½ and most preferred between ½and ¾ of the sand filling period has elapsed. Thereby, the fluidisation of the sand may be terminated when a last part of the moulding chamber 2 is to be filled with sand, and it may be ensured that sand in the lower part of the moulding chamber 2 to some extent starts precompacting as fluidisation stops before the last part of the moulding chamber 2 is filled with sand so that the moulding chamber may be completely filled.

In the embodiments described above, some or all of the compressed air inlet openings 18, 18*a*, 18*b* could also have the additional function of air vent nozzles, when a pre-set end time for the above described fluidisation has been reached. This could further assist the dedicated air vent nozzles 34 when the fluidisation has ended. This function could for instance be achieved by arranging some or ail of the fluidisation control valves 22, 30, 31 as three-way valves enabling the additional vent function. Alternatively, separate vent valves could be connected to the compressed air inlet openings 18, 18*a*, 18*b*.

It should be mentioned that throughout this description, according to any embodiment, whenever if is mentioned that a number of the compressed air inlet openings 18, 18*a*, 18*b*, 43 are located in a specific way in the moulding chamber 2, 2*a*, 2*b* or are located in a specific way in the at least one of the chamber walls 3, 4, 5, 7, 8, it should be understood that soma of or ail of the compressed air inlet openings 18, 18*a*, 18*b*, 43 present in the moulding chamber could be located in said specific way in the moulding chamber 2, 2*a*, 2*b* or could be located in said specific way in the at least one of the chamber walls 3, 4, 5, 7, 8.

It should be mentioned that throughout this description, whenever sand is referred to, it should be understood that any suitable particulate material may be applied. The sand or particulate material may typically be so-called green sand (also called clay bound sand), i.e. moulding material based on quartz sand, clay, coal dust and water. However, other particulate materials and binder systems may be applied. In the same manner, when compressed air or air is mentioned, any other suitable gas or gas composition could be applied.

LIST OF REFERENCE NUMBERS

1 sand moulding machine
2, 2*a*, 2*b* moulding chamber
3 chamber top wall
4 chamber bottom wall
5 chamber side wall
7, 8 chamber end wall
9 sand filling opening
10 sand feed system
11 funnel
12, 13 pattern plate
14, 15 pattern
16 pivot axis
17 piston
18, 18*a*, 18*b* compressed air inlet opening
19 compressed air tank
28 inner part of chamber bottom wall
21, 21*a*, 21*b* manifold
22 fluidisation control valve
23, 23*a*, 23*b* sand feed control valve
24 inlet of manifold
25 control unit
26 match plate
27 pattern
28, 29 group of compressed air inlet openings
30 first specific fluidisation control valve
31 second specific fluidisation control valve
32, 33 specific area
34 air vent nozzle
35 outer part of chamber bottom wall
36 peripheral regions of the moulding chamber
37 sand
38 sand container
39 lifting arm
40 pivotal connection
41 deep pocket
42 air vent nozzle
43 compressed air inlet opening
44, 45 group of air vent nozzles

The invention claimed is:

1. A sand moulding machine including a moulding chamber formed by a chamber top wall, a chamber bottom wall, two opposed chamber side walls and two opposed chamber end walls, wherein at least one chamber wall is provided with at least one sand filling opening communicating with a sand feed system, wherein at least one of the chamber end walls is provided with a pattern plate having a pattern, wherein at least one of the chamber end walls is displaceable in order to compact sand fed into the moulding chamber, wherein at least one of the chamber walls is provided with compressed air inlet openings connected to a compressed air source for the delivery of compressed air into the moulding chamber, wherein a number of the compressed air inlet openings are located in a lower part of the moulding chamber, wherein said number of the compressed air inlet openings are arranged to form an upward airflow in at least a part of the moulding chamber in order to create an at least substantially fluidised bed of sand at least adjacent a part of the chamber bottom wall during at least a part of a filling operation whereby the moulding chamber is being filled with sand through the at least one sand filling opening, wherein a number of or all of the compressed air inlet openings are arranged in a number of different groups, and wherein the compressed air inlet openings belonging to a specific group are connected to the compressed air source via a specific fluidisation control valve pertaining to said group and adapted to regulate the supply of compressed air to the compressed air inlet openings belonging to said group, wherein the compressed air inlet openings belonging to a specific group are arranged in a corresponding specific area of the chamber bottom wall and/or of the chamber side walls, and in that a number of said specific areas including compressed air inlet openings belonging to respective specific groups are arranged following each other in the direction from a first chamber end wall to a second chamber end wall.

2. A sand moulding machine according to claim 1, wherein a number of the compressed air inlet openings are adapted to direct air in an upward direction.

3. A sand moulding machine according to claim 2, wherein a number of the compressed air inlet openings are distributed over at least a central area of the chamber bottom wall.

4. A sand moulding machine according to claim 2, wherein a number of the compressed air inlet openings are distributed over at least an area of the chamber bottom wall which is not covered by a projection of the pattern of a pattern plate onto the chamber bottom wall.

5. A sand moulding machine according to claim 1, wherein a number of the compressed air inlet openings are distributed over at least a central area of the chamber bottom wall.

6. A sand moulding machine according to claim 5, wherein a number of the compressed air inlet openings are distributed over at least an area of the chamber bottom wall which is not covered by a projection of the pattern of a pattern plate onto the chamber bottom wall.

7. A sand moulding machine according to claim 2, wherein at least one of the chamber end walls is associated with an air cushion transport system including a number of slide shoes supplied with compressed air and adapted to slide on the chamber bottom wall during displacement of said at least one chamber end wall, and wherein a number of the compressed air inlet openings are distributed over an area of the chamber bottom wall which is not contacted by the slide shoes during displacement of said at least one chamber end wall.

8. A sand moulding machine according to claim 1, wherein a number of the compressed air inlet openings are distributed over at least an area of the chamber bottom wall which is not covered by a projection of the pattern of a pattern plate onto the chamber bottom wall.

9. A sand moulding machine according to claim 1, wherein at least one of the chamber end walls is associated with an air cushion transport system including a number of slide shoes supplied with compressed air and adapted to slide on the chamber bottom wall during displacement of said at least one chamber end wall, and wherein a number of the compressed air inlet openings are distributed over an area of the chamber bottom wall which is not contacted by the slide shoes during displacement of said at least one chamber end wall.

10. A sand moulding machine according to claim 1, wherein a number of the compressed air inlet openings are arranged along a lower edge of at least one of the chamber end walls.

11. A sand moulding machine according to claim 1, wherein at least one of the chamber side walls and/or the chamber top wall is or are provided with a number of air vent nozzles arranged in a number of different groups, and wherein the air vent nozzles belonging to a specific group communicate with a specific air vent control valve pertaining to said group and adapted to regulate a flow of vent air from the air vent nozzles belonging to said group.

12. A sand moulding machine according to claim 10, wherein the air vent nozzles belonging to a specific group are arranged in a corresponding specific area of the chamber side wall, and wherein a number of said specific areas including air vent nozzles belonging to respective specific groups are arranged following each other in a vertical direction.

13. A sand moulding machine according to claim 1, wherein the sand moulding machine includes a control unit adapted to, during at least the filling operation whereby the moulding chamber is being filled with sand through the at least one sand filling opening, open a number of specific fluidisation control valves pertaining to respective groups of compressed air inlet openings so that compressed air is supplied into the moulding chamber through a number of the compressed air inlet openings distributed over a specific area of the chamber bottom wall.

14. A sand moulding machine according to claim 1, wherein a number of the compressed air inlet openings or fluidisation nozzles pertaining to said compressed air inlet openings are directed in an oblique direction relative to the vertical and in the direction of an adjacent pattern plate in order to direct compressed air in the direction of said adjacent pattern plate.

15. A sand moulding machine according to claim 1, wherein compressed air inlet openings or fluidisation nozzles located in the chamber bottom wall and preferably also compressed air inlet openings or fluidisation nozzles located in the chamber side walls have the form of ring-formed apertures, and wherein the ring-formed aperture has the form of a ring-formed groove in the relevant chamber wall or in a part inserted flush with the relevant chamber wall or the ring-formed groove is formed between a hole in the relevant chamber wall and a separate element inserted into said hole.

16. A sand moulding machine according to claim 1, wherein the sand moulding machine includes a control unit adapted to, by means of at least one pressure reduction valve, control the flow of compressed air from the compressed air source to the compressed air inlet openings.

17. A sand moulding machine according to claim 1, wherein the sand moulding machine includes a control unit, wherein the control unit is adapted to control a sand feed control valve adapted to control a flow of compressed air from the compressed air source to the sand feed system, wherein the control unit is adapted to control at least one fluidisation control valve adapted to control the flow of compressed air from the compressed air source to at least a number of the compressed air inlet openings in the at least one of the chamber walls, wherein the control unit is adapted to open the sand feed control valve and thereby initiate the filling operation whereby the moulding chamber is being filled with sand through the at least one sand filling opening, and wherein the control unit is adapted to open the at least one fluidisation control valve simultaneously with, at least substantially simultaneously with, before or after the opening of the sand feed control valve.

18. A sand moulding machine according to claim 17, wherein the control unit is adapted to close the at least one fluidisation control valve after the moulding chamber has been filled with sand and possibly during or after mechanical compaction of the sand by displacement of a chamber end wall.

19. A sand moulding machine according to claim 1, wherein at least some of the compressed air inlet openings have the additional function of air vent nozzles, and wherein at least some or all of the fluidisation control valves have the form of three-way valves enabling the additional vent function and/or separate vent control valves are connected to the compressed air inlet openings.

20. A method of producing moulds, whereby a moulding chamber during a filling operation is filled with sand by means of a sand feed system, and whereby the sand is subsequently compacted, the moulding chamber being formed by a chamber top wall, a chamber bottom wall, two opposed chamber side walls and two opposed chamber end walls, whereby the moulding chamber is filled with sand through at least one sand filling opening provided in at least one chamber wall and communicating with the sand feed system, whereby a mould or mould part is provided with a pattern by means of at least one of the chamber end walls being provided with a pattern plate having a pattern, whereby sand is compacted inside the moulding chamber by displacing at least one of the chamber end walls, whereby an at least substantially fluidised bed of sand is created at least adjacent a part of the chamber bottom wall during at least a part of the filling operation when the moulding chamber is being filled with sand through the at least one sand filling opening, whereby the fluidised bed of sand is created by injection of compressed air into the moulding chamber in such a way that an upward airflow in at least a part of the moulding chamber is achieved, whereby the compressed air is injected through a number of compressed air inlet openings being provided at a lower part of the moulding chamber, whereby a number of or all of the compressed air inlet openings are arranged in a number of different groups, and whereby the supply of compressed air to the compressed air inlet openings belonging to a specific group is regulated by means of a specific fluidisation control valve pertaining to said group, wherein the compressed air inlet openings belonging to a specific group are arranged in a corresponding specific area of the chamber bottom wall and/or of the chamber side walls, and by that a number of said specific areas including compressed air inlet openings belonging to respective specific groups are arranged following each other in the direction from a first chamber end wall to a second chamber end wall.

* * * * *